US007637802B2

(12) United States Patent
Yasuoka et al.

(10) Patent No.: US 7,637,802 B2
(45) Date of Patent: Dec. 29, 2009

(54) LAPPING PLATE RESURFACING ABRASIVE MEMBER AND METHOD

(75) Inventors: Kai Yasuoka, Tokyo (JP); Kenichi Kazama, Tokyo (JP); Ayumi Tsuneya, Tokyo (JP); Shunji Sato, Tokyo (JP)

(73) Assignee: Shinano Electric Refining Co., Ltd., Tokyo (JP)

( * ) Notice: Subject to any disclaimer, the term of this patent is extended or adjusted under 35 U.S.C. 154(b) by 0 days.

(21) Appl. No.: 11/516,634

(22) Filed: Sep. 7, 2006

(65) Prior Publication Data

US 2007/0054607 A1 Mar. 8, 2007

(30) Foreign Application Priority Data

Sep. 8, 2005 (JP) ..... 2005-260526

(51) Int. Cl.
*B24B 1/00* (2006.01)
*B24B 29/00* (2006.01)

(52) U.S. Cl. ..... 451/56; 451/285; 451/41

(58) Field of Classification Search ..... 451/41, 451/56, 444, 285–290, 388, 443; 51/129, 51/132, 235, 283

See application file for complete search history.

(56) References Cited

U.S. PATENT DOCUMENTS

| | | | | | |
|---|---|---|---|---|---|
| 5,441,444 | A | * | 8/1995 | Nakajima | 451/289 |
| 5,536,202 | A | * | 7/1996 | Appel et al. | 451/285 |
| 5,643,067 | A | * | 7/1997 | Katsuoka et al. | 451/444 |
| 5,672,095 | A | * | 9/1997 | Morimoto et al. | 451/41 |
| 6,074,277 | A | * | 6/2000 | Arai | 451/8 |
| 6,102,784 | A | * | 8/2000 | Lichner | 451/262 |
| 6,468,138 | B1 | | 10/2002 | Toyama et al. | |
| 7,326,378 | B2 | | 2/2008 | Yasuoka et al. | |

FOREIGN PATENT DOCUMENTS

| | | | |
|---|---|---|---|
| AU | 10200/70 | | 7/1971 |
| CN | 1621202 | A | 6/2005 |
| EP | 1535701 | A1 | 6/2005 |
| GB | 1226780 | | 3/1971 |
| GB | 2360725 | A | 10/2001 |
| JP | 2000-218521 | A | 8/2000 |
| JP | 2000-135666 | A | 5/2005 |
| WO | WO-02/15247 | A2 | 2/2002 |
| WO | WO-03/082519 | A1 | 10/2003 |

* cited by examiner

*Primary Examiner*—Lee D Wilson
(74) *Attorney, Agent, or Firm*—Birch, Stewart, Kolasch & Birch, LLP

(57) ABSTRACT

A lapping machine includes a lapping plate, and a workpiece carrier with a workpiece-holding hole disposed on the plate, a workpiece being fitted within the hole in the carrier. The workpiece is lapped while the plate and the carrier are individually rotated and loose abrasive grains are fed onto the plate. A synthetic resin-based elastic abrasive member having a Rockwell hardness (HRS) in the range of −30 to −100 is effective for resurfacing the lapping plate.

14 Claims, 7 Drawing Sheets

ABRASIVE MEMBER NO. 1 ×150

ABRASIVE MEMBER NO. 2 ×150

LAPPING PLATE RESURFACING ABRASIVE MEMBER AND METHOD

CROSS-REFERENCE TO RELATED APPLICATION

This non-provisional application claims priority under 35 U.S.C. §119(a) on Patent Application No. 2005-260526 filed in Japan on Sep. 8, 2005, the entire contents of which are hereby incorporated by reference.

TECHNICAL FIELD

This invention generally relates to a lapping machine comprising a lapping plate, and a workpiece carrier with a workpiece-holding hole disposed on the plate, a workpiece being fitted within the hole in the carrier, wherein the workpiece is lapped while the plate and the carrier are individually rotated, and loose abrasive grains are fed to the plate. More particularly, it relates to an abrasive member and method for regulating (or resurfacing) the surface of the lapping plate.

BACKGROUND ART

In the prior art, a lapping machine as shown in FIG. 1 is used for lapping workpieces such as silicon wafers, synthetic quartz glass, rock crystal, liquid crystal glass, and ceramics. The machine of FIG. 1 includes a lower lapping plate 1 made of spheroidal-graphite cast iron. The plate 1 is coupled for rotation to a drive (not shown). On the inner diameter side of the plate, a sun gear 2 is disposed at the center. An annular or internal gear 3 is disposed along the outer periphery of the plate 1. A plurality of carriers 4 are disposed in mesh engagement with the gears 2 and 3. Each carrier 4 is provided with workpiece-holding holes 5. A workpiece 6 is fitted within each holding hole 5. Above the carriers 4, an upper lapping plate may be disposed for rotation like the lower lapping plate 1, though not shown. When the plate 1 is rotated, the carriers 4 are rotated counter to the plate rotation. Then, the workpieces 6 are lapped with loose abrasive grains fed to the plate as the workpieces revolve about the gear 2 and rotate about their own axes.

As polishing and lapping steps are repeated using the lapping machine described above, the plate is worn to assume a convex or irregular shape. Once the plate is worn to such a shape, a plate-dressing jig made of the same cast iron material as the plate is used to true the plate surface for flatness while loose abrasive grains are fed thereto. After the plate is dressed in this way, it can be used again to repeat polishing and lapping steps in a similar manner. Known plate-dressing jigs used in the art for dressing the surface accuracy of the plate of the lapping machine for carrying out polishing and lapping steps include those described in JP-A 2000-135666 and JP-A 2000-218521.

Although these plate-dressing jigs are effective for dressing the lapping plates for flatness, they are ineffective in increasing the efficiency of lapping operation. It would be desirable to have a method of carrying out more efficient lapping operation.

DISCLOSURE OF THE INVENTION

An object of the invention is to provide a lapping plate resurfacing abrasive member which can resurface a lapping plate so as to increase the loose abrasive grain holding force of the plate for thereby improving its lapping force, and provide the plate with a uniform rough surface for imparting to the plate a surface state capable of developing a stable constant lapping force during the operation from immediately after resurfacing; and a plate resurfacing method using the abrasive member.

The inventors have found that when a lapping plate is regulated for surface roughness by using a synthetic resin-based elastic abrasive member having a Rockwell hardness (HRS) in the range of −30 to −100, especially a porous synthetic resin-based elastic abrasive member having a large number of microscopic cells in the interior, and feeding loose abrasive grains which are the same as loose abrasive grains to be fed onto the plate when a workpiece such as silicon wafers, synthetic quartz glass, rock crystal, liquid crystal glass, and ceramics is lapped, the plate surface is regulated (or resurfaced) to a surface roughness which is about 1.5 to 3 times rougher than the surface roughness of a plate reached when the plate surface is dressed by using a plate-dressing jig made of ceramics, metals or the like such as a dressing ring and feeding the same abrasive grains. Then, when a workpiece is actually lapped using the resurfaced plate together with loose abrasive grains, the resurfaced plate on its surface has an increased abrasive grain holding force and hence, an improved finishing force. This reduces the lapping time and enables efficient lapping of the workpiece. The machining force is constant throughout the lapping operation even from the initial operation after the resurfacing, and the workpiece can be given a stable uniform finish surface, and the lapping force is stabilized. In these regards too, the lapping process becomes more efficient.

The invention pertains to a lapping machine comprising a lapping plate, and a workpiece carrier with a workpiece-holding hole disposed on the plate, a workpiece being fitted within the hole in the carrier, wherein the workpiece is lapped while the plate and the carrier are individually rotated and loose abrasive grains are fed onto the plate.

In one aspect, the invention provides an abrasive member for resurfacing the lapping plate which is a synthetic resin-based elastic abrasive member having a Rockwell hardness (HRS) in the range of −30 to −100.

Preferably, the synthetic resin-based elastic abrasive member is porous. More preferably, the elastic abrasive member is a polyurethane or polyvinyl acetal-based abrasive member having a large number of microscopic cells. Even more preferably, the elastic abrasive member has a bulk density of 0.4 to 0.9 g/cm$^3$. Typically, the elastic abrasive member has abrasive grains dispersed and bound therein which are the same as the loose abrasive grains fed onto the plate when the workpiece is lapped.

In another aspect, the invention provides a method for resurfacing a lapping plate, comprising the steps of placing a resurfacing carrier with a holding hole on the lapping plate, holding within the carrier hole a synthetic resin-based elastic abrasive member having a Rockwell hardness (HRS) in the range of −30 to −100, rotating the plate and the carrier individually, and feeding loose abrasive grains onto the plate, for thereby lapping the surface of the plate with the elastic abrasive member for roughening the plate surface in accordance with the coarseness of the abrasive grains.

Preferably, the abrasive grains are the same as loose abrasive grains to be fed onto the plate when a workpiece is lapped. Also preferably, the synthetic resin-based elastic abrasive member is porous. More preferably, the elastic abrasive member is a polyurethane or polyvinyl acetal-based abrasive member having a large number of microscopic cells. More preferably, the elastic abrasive member has a bulk density of 0.4 to 0.9 g/cm$^3$. Typically, the elastic abrasive member has abrasive grains dispersed and bound therein which are the same as loose abrasive grains to be fed onto the plate when a workpiece is lapped.

Often, the workpiece is selected from among silicon wafers, synthetic quartz glass, rock crystal, liquid crystal glass, and ceramics.

BENEFITS OF THE INVENTION

According to the invention, workpieces such as silicon wafers, synthetic quartz glass, rock crystal, liquid crystal glass, and ceramics can be efficiently lapped. The invention is thus effective in reducing the time and cost of lapping. Workpieces as lapped have a surface roughness with minimal variations, indicating the delivery of workpieces of consistent quality.

DESCRIPTION OF THE PREFERRED EMBODIMENTS

Figure 1:
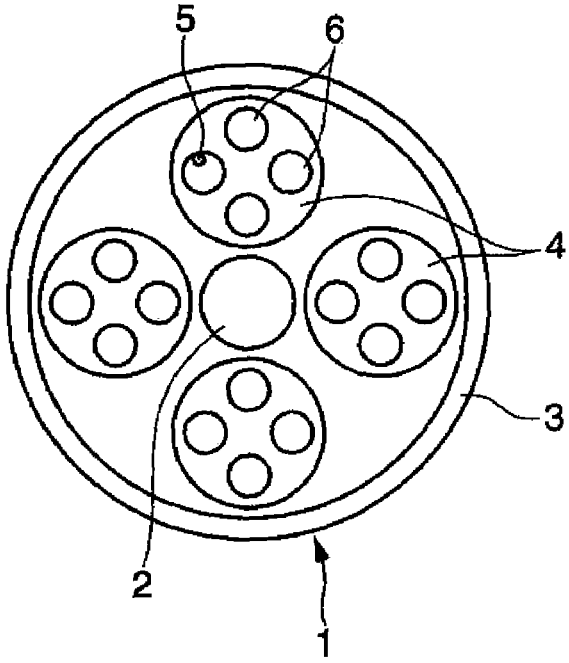
FIG.1 PRIOR ART
FIG. 1 is a plan view of a workpiece lapping machine with an upper plate removed.

The terms "a" and "an" herein do not denote a limitation of quantity, but rather denote the presence of at least one of the referenced item. The term "abrasive member" is exchangeable with lapping wheel or grinding tool or grindstone. The term "resurfacing" means that the surface of a lapping plate is regulated to an appropriate roughness rather than to a certain flatness.

The lapping plate resurfacing abrasive member of the invention comprises an elastic abrasive member made of synthetic resin. The elastic abrasive member used herein is preferably selected from porous elastic abrasive members having a large number of microscopic cells in its interior and made of thermosetting resins, and especially porous elastic abrasive members having a large number of microscopic cells in its interior and made of polyvinyl acetal or polyurethane. Examples of the thermosetting resin include, but are not limited to, polyvinyl acetal resins, phenolic resins, melamine resins, urea resins, acrylic resins, methacrylic resins, epoxy resins, polyester resins, and polyurethane resins, which may be used alone or in admixture.

Abrasive members made of materials comprising polyvinyl acetal are preferred for hardness and wear. Preferred polyvinyl acetal-based elastic abrasive members are those made of mixtures of a polyvinyl acetal resin and another thermosetting resin. The mixtures preferably consist of 10 to 35 parts by weight of polyvinyl acetal resin and 5 to 20 parts by weight of the other thermosetting resin. Outside the range, a smaller proportion of polyvinyl acetal resin results in an abrasive member which may include a less proportion of porous moiety, lose elasticity and have a higher hardness whereas a smaller proportion of the other thermosetting resin may adversely affect a binding force between the porous moiety of polyvinyl acetal resin and fine abrasive grains, resulting in an abrasive member with a lower hardness.

As mentioned above, the polyvinyl acetal-based elastic abrasive member should preferably be a porous one having a large number of microscopic cells. One typical means for rendering the abrasive member porous is the previous addition of a cell-forming agent such as corn starch during the polyvinyl acetal resin preparing process. After the acetal-forming reaction, the cell-forming agent is washed away whereby those portions where the cell-forming agent has been present during the reaction are left as cells in the resulting abrasive member.

Also abrasive members made of polyurethane are advantageously used. Polyurethanes are typically prepared through reaction of polyether and/or polyester polyols with organic isocyanates. Suitable polyol components include polyether polyol, diethylene glycol, triethylene glycol, dipropylene glycol, and tripropylene glycol. Suitable organic isocyanates include 4,4'-diphenylmethane diisocyanate and tolylene 2,4-diisocyanate.

Likewise, the polyurethane-based abrasive members are preferably porous. Suitable means for rendering the abrasive member porous include the addition of known blowing agents such as water and the entrapment of air by agitation during the curing reaction.

The porous abrasive member may have either open or closed cell structure, and the cells preferably have a diameter of 30 to 150 μm.

In the synthetic resin-based elastic abrasive member, fine abrasive grains are preferably incorporated. The amount of abrasive grains incorporated is preferably 30 to 70% by weight, more preferably 40 to 60% by weight, based on the total weight of the abrasive member. The abrasive grains preferably have an average grain size of about 40 μm to about 1 μm. As to the material, abrasive grains may be made of silicon carbide, alumina, chromium oxide, cerium oxide, zirconium oxide, zircon sand or the like, alone or in admixture. Preferred are abrasive grains which are identical in material and grain size with the loose abrasive grains that are used in lapping workpieces with lapping plates after the plates are resurfaced according to the invention.

In the embodiment wherein abrasive grains are compounded in resin, the resulting abrasive member has abrasive grains dispersed and bound therein, and thus becomes more efficient in plate resurfacing. In the preferred embodiment wherein abrasive grains which are the same as loose abrasive grains used in workpiece lapping are dispersed and bound in the abrasive member, no problems arise after a plate is resurfaced using this abrasive member. That is, even if some abrasive grains are removed from the abrasive member and left on the plate surface, the trouble that the remaining abrasive grains cause scratches to workpieces is avoided because they are the same as loose abrasive grains used in workpiece lapping.

The synthetic resin-based elastic abrasive member should have a Rockwell hardness (HRS) in the range of −30 to −100, and especially in the range of −50 to −80. Outside the range, too low a Rockwell hardness allows the abrasive member to be worn much during lapping, which is uneconomical. With too high a Rockwell hardness, the elastic abrasive member loses the characteristic spring effect and fails in uniformly resurfacing the plate surface. The Rockwell hardness is a measurement on the HRS scale including a test load of 100 kg and a steel ball indenter with a diameter of ½ inch.

As mentioned above, the preferred elastic abrasive member is a porous abrasive member having a large number of microscopic cells in the interior. In this preferred embodiment, the cells preferably have a diameter of 30 to 150 μm, more preferably 40 to 100 μm. If the cell diameter is less than 30 μm, the abrasive member may have less elasticity, losing the spring effect. If the cell diameter is more than 150 μm, the spring effect is readily available, but the abrasive member structure becomes coarse and can be worn much, which is uneconomical. The elastic abrasive member preferably has a bulk density of 0.4 to 0.9 g/cm$^3$, and more preferably 0.5 to 0.7 g/cm$^3$. If the bulk density is too low, the abrasive member has a coarse structure, becomes brittle as a whole, and can break during the lapping operation. If the bulk density is too high, the abrasive member has an over-densified structure, lowing the spring effect due to elasticity.

It is noted that the shape of the abrasive member is not particularly limited and it may be formed to any planar shapes including circular and regular polygonal shapes such as square, hexagonal and octagonal shapes. Its thickness is preferably about 10 mm to about 75 mm.

The time when a lapping plate is resurfaced using the resurfacing abrasive member in the form of an elastic abrasive member is not particularly limited. The resurfacing abrasive member of the invention is not effective in dressing raised portions or raised and recessed portions on the plate surface, created during the service of the plate, for flattening the plate surface. In such a case, preferably a well-known dressing jig is used to dress the plate surface, before the abrasive member of the invention is used for resurfacing.

Figure 2:
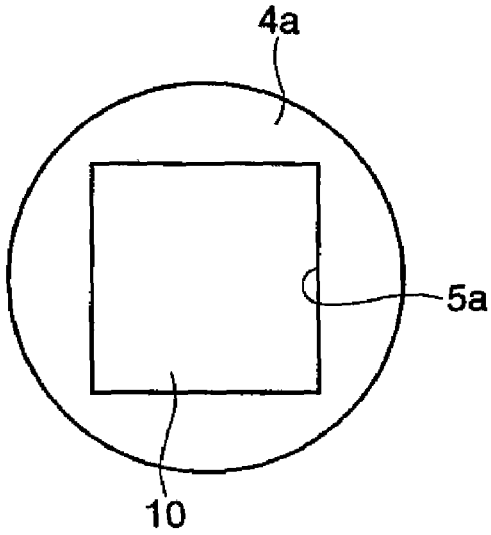
FIG. 2 is a plan view of an exemplary resurfacing carrier.

When resurfacing of a lapping plate is carried out using the plate resurfacing abrasive member of the invention, there is first furnished a regulatory carrier with an elastic abrasive member holding hole. The elastic abrasive member is held within the carrier hole. At this point, if the abrasive member has an appropriate planar shape to fit within a workpiece holding hole in a carrier as shown in FIG. 1, that is, the same shape as the workpiece, this carrier can be used directly as the regulatory carrier, and if so, the abrasive member is fitted within the workpiece holding hole. If the abrasive member has a different shape from the workpiece, there is furnished a regulatory carrier with a holding hole of the same planar shape as the abrasive member, and the abrasive member is fitted within this holding hole. For example, if the abrasive member is square in planar shape, a regulatory carrier 4*a* with a square shaped holding hole 5*a* as shown in FIG. 2 is furnished, and a plate resurfacing abrasive member 10 is fitted within the hole 5*a*. In the arrangement shown in FIG. 1, for example, the regulatory carrier 4*a* is incorporated in the lapping machine in place of the carrier 4 whereupon the plate surface is lapped while feeding loose abrasive grains onto the plate as in the ordinary lapping of workpieces. The regulatory carrier is desirably made of the same material as the workpiece holding carrier or the lapping plate because this avoids the entry of any foreign material. Usually, the carriers are made of iron, cast iron, epoxy resins, vinyl chloride resins or the like.

The lapping conditions for resurfacing may be selected as appropriate although they are preferably selected to be identical with the lapping conditions under which workpieces are lapped after the resurfacing.

When the lapping treatment of the plate is conducted by the elastic abrasive member, it is preferred to use loose abrasive grains which are the same as the loose abrasive grains used in the subsequent lapping of workpieces. This is convenient in that even if some loose abrasive grains are left on the plate after the lapping treatment of the plate by the elastic abrasive member, the remaining abrasive grains do not disturb the subsequent lapping of workpieces.

Figure 3:
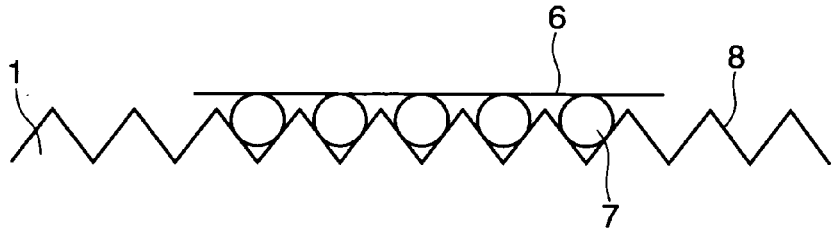
FIG. 3 schematically illustrates the surface of a plate which has been lapped using an abrasive member of the invention.
Figure 4:
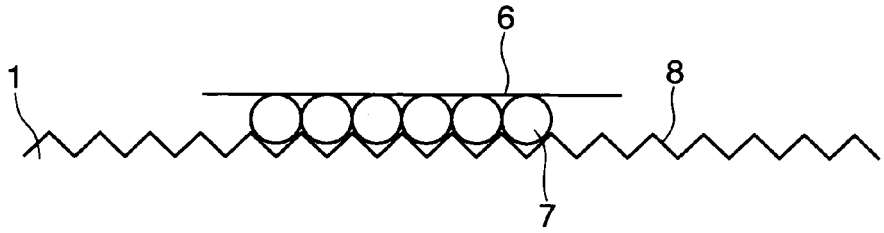
FIG.4 PRIOR ART
FIG. 4 schematically illustrates the surface of a plate which has been dressed and lapped using a plate-dressing jig.

When the lapping treatment of the plate is conducted by the synthetic resin-based elastic abrasive member, the plate surface is roughened depending on the material, grain size and other parameters of loose abrasive grains. Specifically, the plate surface is regulated to a surface roughness which is about 1.5 to 3 times rougher than the surface roughness of a plate reached when the plate surface is dressed by using a plate-dressing jig made of the same material as the plate, like cast iron, ceramics or electroplated diamond, and feeding the same loose abrasive grains. This difference is readily understood by referring to FIGS. 3 and 4. FIG. 3 schematically illustrates the surface state of a plate 1 which has been lapped using an elastic abrasive member of the invention. In contrast, FIG. 4 schematically illustrates the surface state of a plate 1 which has been lapped using a plate-dressing jig or ring made of the same cast iron as the plate.

Figure 5:
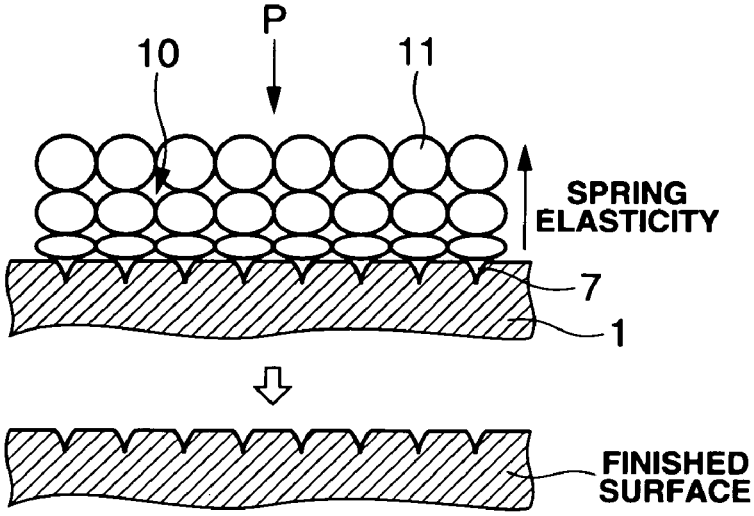
FIG. 5 is a schematic cross-sectional view of a plate which has been lapped using an elastic abrasive member.
Figure 6:
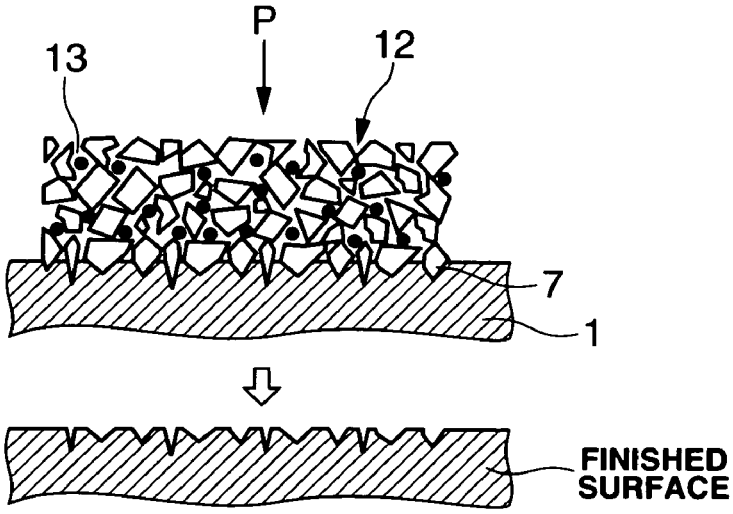
FIG.6 PRIOR ART
FIG. 6 is a schematic cross-sectional view of a plate which has been lapped using a non-elastic abrasive member.

Specifically, reference is made to an example wherein an elastic abrasive member is used, and particularly wherein an elastic abrasive member made of porous synthetic resin is used. As shown in FIG. 5, the surface of a plate 1 is lapped while pressing the plate resurfacing abrasive member (elastic abrasive member) 10 downward and feeding loose abrasive grains 7. When pressure P is applied while feeding loose abrasive grains 7 in between the plate 1 and the elastic abrasive member 10, the elastic abrasive member exhibits spring elasticity due to microscopic cells 11 contained in the elastic abrasive member 10 structure. As a result, the plate is provided with a rough surface having a uniform and higher roughness, independent of any variations of the applied pressure. In contrast, as shown in FIG. 6, a non-elastic vitrified abrasive member or resinoid bonded abrasive member 12 consisting of abrasive grains bonded with a binder 13 contains no pores in the interior and lacks spring elasticity because of the absence of cells. As a result, a surface having a uniform roughness is not readily obtained and the resulting roughness is relatively low.

As discussed above, when the plate is resurfaced according to the invention, the surface of the plate 1 is roughened to an appropriate roughness as compared with the use of conventional plate-dressing jigs. As shown in FIG. 3, loose abrasive grains 7 are effectively captured within raised and recessed portions 8 on the roughened surface of the plate 1, preventing the grains from popping and falling out of the plate surface. This allows, during the lapping of a workpiece 6, loose abrasive grains to exert a lapping force. As a result, the workpiece can be lapped within a short time and the amount of loose abrasive grains used in the lapping be reduced.

EXAMPLE

Examples of the invention are given below by way of illustration and not by way of limitation.

Example I and Comparative Example I

The lapping machine used was a 4-way double-sided lapping machine, Model 15B by Fujikoshi Machinery Corp. First, for the upper and lower lapping plates, surface dressing was carried out by the following method and under the following conditions, using dressing rings.

Plate:
Material: spheroidal-graphite cast iron
Size: 15B

Dressing ring:
Material: same as the plates
Number: 4
Size: 380 mm diameter

Dressing method and conditions:
Lapping load: 100 g/cm$^2$
Lower plate rotation: 65 rpm
Upper plate rotation: 21.5 rpm
Loose abrasive grains: FO #1200
Abrasive slurry: 20% dispersion
Abrasive slurry feed rate: 180 cc/min
Lapping time: 30 min After the upper and lower plates were surface-dressed with the dressing rings, the upper and lower plates were resurfaced by the following method and under the following conditions, using plate resurfacing abrasive members as described below.

Figure 12:
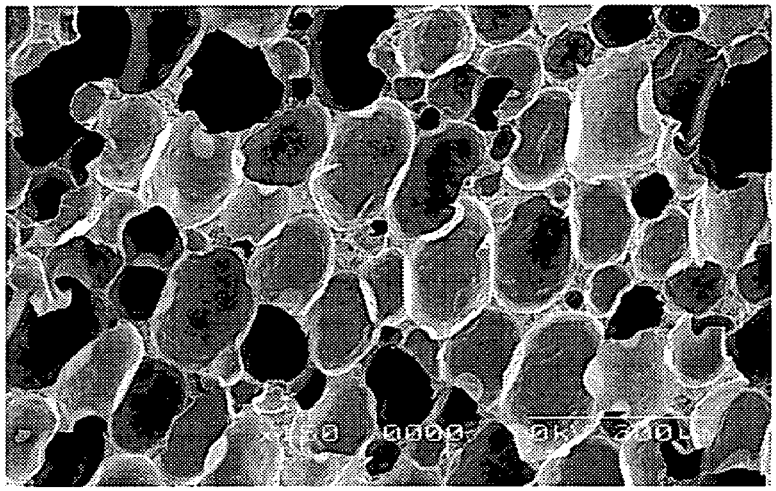
FIG. 12 is a photomicrograph of plate resurfacing abrasive member No. 1.
Figure 13:
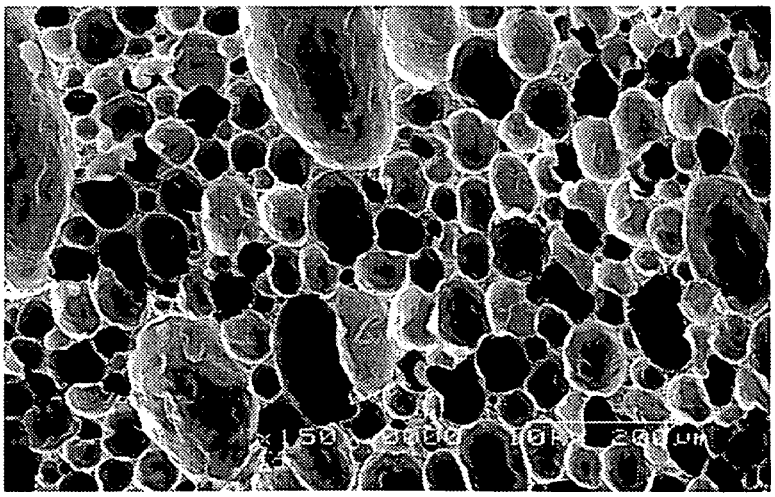
FIG. 13 is a photomicrograph of plate resurfacing abrasive member No. 2.

Plate resurfacing abrasive member No. 1 (see FIG. 12):
Shape and size: 150 mm diameter disks
Number: 12
Material: polyurethane
cells: 100 μm diameter
Rockwell hardness: −80
Bulk density: 0.5 g/cm$^3$ Plate resurfacing abrasive member No. 2 (see FIG. 13):
Shape and size: 150 mm diameter disks
Number: 12
Material: polyurethane
cells: 50 μm diameter
Rockwell hardness: −70
Bulk density: 0.6 g/cm$^3$ Regulatory carrier:
Material: cast iron (same as the plates)
Number: 4
Size: 380 mm diameter Resurfacing method and conditions:
same as the plate dressing method using dressing rings
Lapping load: 100 g/cm$^2$
Lower plate rotation: 65 rpm
Upper plate rotation: 21.5 rpm
Loose abrasive grains: FO #1200
Abrasive slurry: 20% dispersion
Abrasive slurry feed rate: 180 cc/min
Lapping time: 30 min After the plates were dressed or resurfaced as described above, the plates were measured for surface roughness, data of which are shown in Table 1.

TABLE 1

| | Dressing ring | | Abrasive member No. 1 | | Abrasive member No. 2 | |
|---|---|---|---|---|---|---|
| | Ra | Rz | Ra | Rz | Ra | Rz |
| After dressing or resurfacing | 0.21 | 2.68 | 0.52 | 4.81 | 0.37 | 5.27 |

Ra: center line average roughness
Rz: ten-point average roughness
Surface roughness: JIS B0601

It is noted that the dressing operation using dressing rings was successful in flattening the plate surface. By contrast, in the processing using the resurfacing abrasive member, the flat state of the plate surface remained substantially unchanged before and after the processing, suggesting that the resurfacing abrasive member does not have a function of flattening and dressing irregularities on the plate surface.

Figure 7:
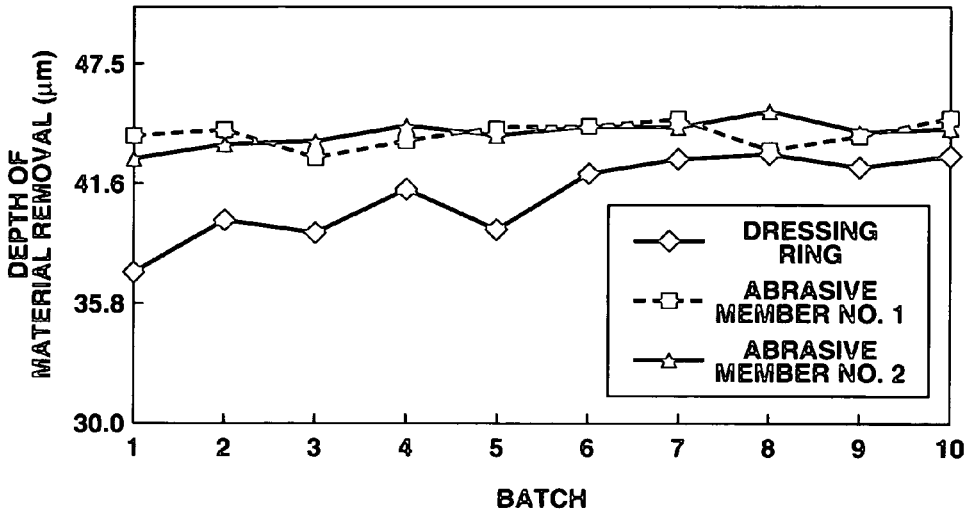
FIG. 7 is a graph showing depth of material removal versus batch number when silicon wafers are lapped in Example I and Comparative Example I.

Next, using the plates whose surface was dressed by the dressing rings and the plates whose surface was resurfaced by resurfacing abrasive member Nos. 1 and 2, silicon wafers were repeatedly lapped under the following conditions and by the same method as shown in FIG. 1. The results are shown in Tables 2 to 4 and FIG. 7.

Workpiece: silicon wafer
Workpiece size: 31.4 cm$^2$
Number of workpieces per batch: 35
Lapping time per batch: 10 min
Recycle: yes
Upper plate rotation: 21.5 rpm
Lower plate rotation: 65 rpm
Load: 100 g/cm$^2$
Abrasive slurry: 20 wt % dispersion
Anti-rust agent: 1%
Abrasive slurry feed rate: 180 ml/min
Abrasive grains: FO #1200
Abrasive member size: 151×40×50
Carrier material: vinyl chloride resin
Carrier size: 380 mm diameter
Workpieces on carrier: seven 4-inch silicon wafers
Number of carriers: 5

TABLE 2

| | Dressing ring | | |
|---|---|---|---|
| Batch No. | Workpiece thickness before lapping | Workpiece thickness after lapping | Depth of material removal (μm) |
| 1 | 542.5 | 505.2 | 37.3 |
| 2 | 542.5 | 502.6 | 39.9 |
| 3 | 542.1 | 502.9 | 39.2 |
| 4 | 542.0 | 500.7 | 41.3 |
| 5 | 541.9 | 502.6 | 39.3 |
| 6 | 542.1 | 500.1 | 42.0 |
| 7 | 542.1 | 499.4 | 42.7 |
| 8 | 542.3 | 499.3 | 43.0 |
| 9 | 543.1 | 500.8 | 42.3 |
| 10 | 542.3 | 499.5 | 42.8 |
| | | Standard deviation | 1.9 |
| | | Total depth of material removal | 409.8 |

TABLE 3

| Abrasive member No. 1 | | | |
|---|---|---|---|
| Batch No. | Workpiece thickness before lapping | Workpiece thickness after lapping | Depth of material removal (μm) |
| 1 | 538.1 | 494.3 | 43.8 |
| 2 | 538.0 | 493.9 | 44.1 |
| 3 | 538.1 | 495.3 | 42.8 |
| 4 | 538.3 | 494.7 | 43.6 |
| 5 | 538.1 | 494.0 | 44.1 |
| 6 | 539.0 | 494.8 | 44.2 |
| 7 | 538.5 | 493.9 | 44.6 |
| 8 | 537.0 | 493.9 | 43.1 |
| 9 | 537.1 | 493.4 | 43.7 |
| 10 | 537.2 | 492.7 | 44.5 |
| | | Standard deviation | 0.5 |
| | | Total depth of material removal | 438.5 |

TABLE 4

| Abrasive member No. 2 | | | |
|---|---|---|---|
| Batch No. | Workpiece thickness before lapping | Workpiece thickness after lapping | Depth of material removal (μm) |
| 1 | 536.6 | 493.9 | 42.7 |
| 2 | 538.3 | 494.8 | 43.5 |
| 3 | 537.4 | 493.7 | 43.7 |
| 4 | 537.6 | 493.3 | 44.3 |
| 5 | 537.5 | 493.5 | 44.0 |
| 6 | 537.1 | 492.8 | 44.3 |
| 7 | 537.4 | 493.1 | 44.3 |
| 8 | 537.7 | 492.8 | 44.9 |
| 9 | 537.3 | 493.3 | 44.0 |
| 10 | 537.5 | 493.4 | 44.1 |
| | | Standard deviation | 0.6 |
| | | Total depth of material removal | 439.8 |

Example II and Comparative Example II

The lapping machine used was a 4-way double-sided lapping machine, Model 6B by Fujikoshi Machinery Corp. First, for the upper and lower lapping plates, surface dressing was carried out by the following method and under the following conditions, using dressing rings.

Plate:

Material: spheroidal-graphite cast iron

Size: 6B

Dressing ring:

Material: same as the plates

Number: 4

Size: 150 mm diameter

Dressing method and conditions:

Lapping load: 100 g/cm$^2$

Lower plate rotation: 60 rpm

Upper plate rotation: 20 rpm

Loose abrasive grains: GC #1500

Abrasive slurry: 25% dispersion

Abrasive slurry feed rate: 500 cc/min

Lapping time: 30 min

After the upper and lower plates were surface-dressed with the dressing rings, the upper and lower plates were resurfaced by the following method and under the following conditions, using plate resurfacing abrasive members as described below.

Plate resurfacing abrasive member No. 3:

Shape and size: 120 mm diameter disks

Number: 4

Material: polyvinyl acetal and melamine resins cells: 60 μm diameter

Rockwell hardness: −60

Bulk density: 0.7 g/cm$^3$

Plate resurfacing abrasive member No. 4:

Shape and size: 120 mm diameter disks

Number: 4

Material: polyurethane cells: 100 μm diameter

Rockwell hardness: −80

Bulk density: 0.5 g/cm$^3$

Regulatory carrier:

Material: cast iron (same as the plates)

Number: 4

Size: 150 mm diameter

Resurfacing method and conditions:

same as the plate dressing method using dressing rings

Lapping load: 100 g/cm$^2$

Lower plate rotation: 60 rpm

Upper plate rotation: 20 rpm

Loose abrasive grains: GC #1500

Abrasive slurry: 25% dispersion

Abrasive slurry feed rate: 500 cc/min

Lapping time: 30 min

Figure 8:
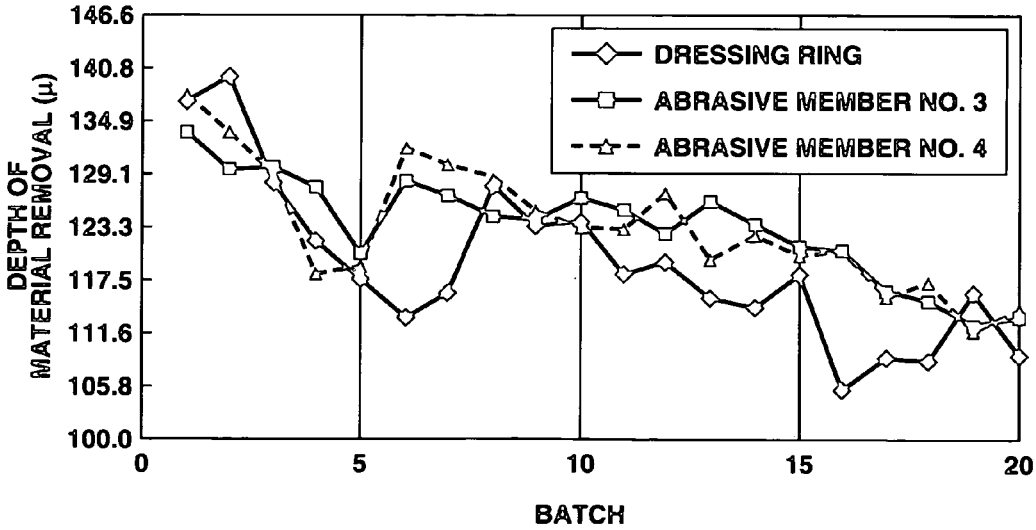
FIG. 8 is a graph showing depth of material removal versus batch number when synthetic quartz glass substrates are lapped in Example II and Comparative Example II.
Figure 9:
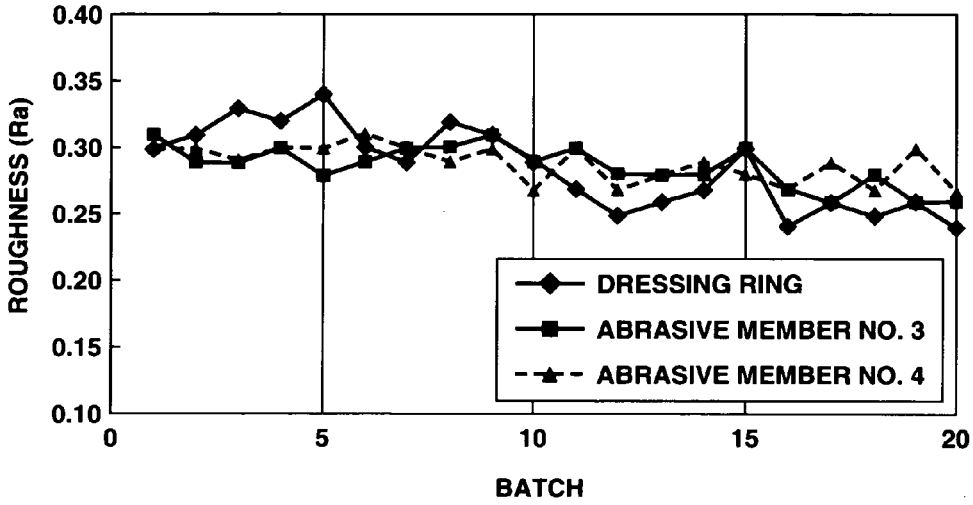
FIG. 9 is a graph showing surface roughness versus batch number in Example II and Comparative Example II.

Next, using the plates whose surface was dressed by the dressing rings and the plates whose surface was resurfaced by resurfacing abrasive member Nos. 3 and 4, synthetic quartz glass substrates were repeatedly lapped under the following conditions and by the same method as shown in FIG. 1. The results are shown in Tables 5 to 7 and FIGS. 8 and 9.

Workpiece: synthetic quartz glass

Workpiece size: 76 mm×76 mm

Number of workpieces per batch: 6

Lapping time per batch: 10 min

Recycle: yes

Plate size: 6B

Upper plate rotation: 20 rpm

Lower plate rotation: 60 rpm

Load: 100 g/cm$^2$

Abrasive slurry: 25 wt % dispersion

Anti-rust agent: 1%

Abrasive slurry feed rate: 500 ml/min

Abrasive grains: GC #1500

Carrier material: vinyl chloride resin

Carrier size: 150 mm diameter

Number of carriers: 6

TABLE 5

| Dressing ring | | | | | | | | |
|---|---|---|---|---|---|---|---|---|
| Batch No. | Workpiece thickness before lapping | Workpiece thickness after lapping | Depth of material removal (μm) | Weight before lapping (g) | Weight after lapping (g) | Weight loss (g) | Surface roughness Ra | Surface roughness Rz |
| 1 | 2189.0 | 2051.5 | 137.5 | 165.6 | 155.3 | 10.3 | 0.30 | 2.41 |
| 2 | 2190.6 | 2050.6 | 140.0 | 165.3 | 155.1 | 10.2 | 0.31 | 2.43 |
| 3 | 1751.8 | 1623.8 | 128.0 | 132.7 | 122.5 | 10.2 | 0.33 | 2.37 |
| 4 | 1751.6 | 1629.7 | 121.9 | 132.7 | 123.0 | 9.7 | 0.32 | 2.24 |
| 5 | 1749.8 | 1632.1 | 117.7 | 132.8 | 123.3 | 9.5 | 0.34 | 2.34 |
| 6 | 2051.5 | 1938.0 | 113.5 | 155.3 | 146.4 | 8.9 | 0.30 | 2.27 |
| 7 | 2050.6 | 1934.6 | 116.0 | 155.1 | 146.1 | 9.0 | 0.29 | 2.17 |
| 8 | 1623.8 | 1496.1 | 127.7 | 122.5 | 112.9 | 9.6 | 0.32 | 2.34 |
| 9 | 1629.7 | 1506.3 | 123.4 | 123.0 | 113.7 | 9.3 | 0.31 | 2.08 |
| 10 | 1632.1 | 1508.0 | 124.1 | 123.3 | 114.1 | 9.2 | 0.29 | 2.03 |
| 11 | 1938.0 | 1819.8 | 118.2 | 146.4 | 138.0 | 8.4 | 0.27 | 1.90 |
| 12 | 1934.6 | 1814.8 | 119.8 | 146.1 | 137.3 | 8.8 | 0.25 | 2.01 |
| 13 | 1496.1 | 1380.5 | 115.6 | 112.9 | 104.3 | 8.6 | 0.26 | 1.80 |
| 14 | 1506.3 | 1391.8 | 114.5 | 113.7 | 105.1 | 8.6 | 0.27 | 2.27 |
| 15 | 1508.0 | 1389.8 | 118.2 | 114.1 | 105.2 | 8.9 | 0.30 | 2.04 |
| 16 | 1819.8 | 1714.6 | 105.2 | 138.0 | 130.2 | 7.8 | 0.24 | 1.96 |
| 17 | 1814.8 | 1705.8 | 109.0 | 137.3 | 129.4 | 7.9 | 0.26 | 1.84 |
| 18 | 1380.5 | 1271.8 | 108.7 | 104.3 | 96.2 | 8.1 | 0.25 | 1.99 |
| 19 | 1391.8 | 1275.8 | 116.0 | 105.1 | 96.7 | 8.4 | 0.26 | 1.87 |
| 20 | 1389.8 | 1280.5 | 109.3 | 105.2 | 96.7 | 8.5 | 0.24 | 1.83 |
| | Standard deviation | | 8.9 | Standard deviation | | 0.7 | | |
| | Total depth of material removal | | 2384 | Total weight loss | | 179.9 | | |

TABLE 6

| Abrasive member No. 3 | | | | | | | | |
|---|---|---|---|---|---|---|---|---|
| Batch No. | Workpiece thickness before lapping | Workpiece thickness after lapping | Depth of material removal (μm) | Weight before lapping (g) | Weight after lapping (g) | Weight loss (g) | Surface roughness Ra | Surface roughness Rz |
| 1 | 1715.5 | 1581.5 | 134.0 | 130.1 | 119.7 | 10.4 | 0.31 | 2.47 |
| 2 | 1706.1 | 1576.5 | 129.6 | 129.4 | 119.4 | 10.0 | 0.29 | 2.23 |
| 3 | 1751.6 | 1621.8 | 129.8 | 132.8 | 122.7 | 10.1 | 0.29 | 2.34 |
| 4 | 1745.6 | 1618.0 | 127.6 | 132.1 | 122.4 | 9.7 | 0.30 | 2.31 |
| 5 | 1734.8 | 1614.3 | 120.5 | 131.6 | 122.1 | 9.5 | 0.28 | 2.28 |
| 6 | 1581.5 | 1453.0 | 128.5 | 119.7 | 110.2 | 9.5 | 0.29 | 2.23 |
| 7 | 1576.5 | 1449.8 | 126.7 | 119.4 | 110.0 | 9.4 | 0.30 | 2.03 |
| 8 | 1621.8 | 1497.3 | 124.5 | 122.7 | 113.4 | 9.3 | 0.30 | 2.04 |
| 9 | 1618.0 | 1493.8 | 124.2 | 122.4 | 112.8 | 9.6 | 0.31 | 2.29 |
| 10 | 1614.3 | 1487.8 | 126.5 | 122.1 | 112.5 | 9.6 | 0.29 | 2.36 |
| 11 | 1453.0 | 1327.8 | 125.2 | 110.2 | 100.6 | 9.6 | 0.30 | 2.07 |
| 12 | 1449.8 | 1327.3 | 122.5 | 110.0 | 100.5 | 9.5 | 0.28 | 2.07 |
| 13 | 1497.3 | 1371.1 | 126.2 | 113.4 | 103.6 | 9.8 | 0.28 | 2.10 |
| 14 | 1493.8 | 1370.3 | 123.5 | 112.8 | 103.5 | 9.3 | 0.28 | 2.18 |
| 15 | 1487.8 | 1366.8 | 121.0 | 112.5 | 103.1 | 9.4 | 0.30 | 2.12 |
| 16 | 1327.8 | 1207.1 | 120.7 | 100.6 | 91.1 | 9.5 | 0.27 | 1.98 |
| 17 | 1327.3 | 1211.0 | 116.3 | 100.5 | 91.6 | 8.9 | 0.26 | 2.09 |
| 18 | 1371.1 | 1256.1 | 115.0 | 103.6 | 94.9 | 8.7 | 0.28 | 2.02 |
| 19 | 1370.3 | 1257.8 | 112.5 | 103.5 | 95.0 | 8.5 | 0.26 | 1.81 |
| 20 | 1366.8 | 1253.3 | 113.5 | 103.1 | 94.6 | 8.5 | 0.26 | 1.87 |
| | Standard deviation | | 5.6 | Standard deviation | | 0.5 | | |
| | Total depth of material removal | | 2468.3 | Total weight loss | | 188.8 | | |

TABLE 7

| Abrasive member No. 4 | | | | | | | | |
|---|---|---|---|---|---|---|---|---|
| Batch No. | Workpiece thickness before lapping | Workpiece thickness after lapping | Depth of material removal (μm) | Weight before lapping (g) | Weight after lapping (g) | Weight loss (g) | Surface roughness Ra | Surface roughness Rz |
| 1 | 1738.5 | 1600.5 | 138.0 | 131.7 | 121.1 | 10.6 | 0.30 | 2.34 |
| 2 | 1743.3 | 1610.3 | 133.0 | 131.8 | 121.6 | 10.2 | 0.30 | 2.30 |
| 3 | 1740.1 | 1611.1 | 129.0 | 131.7 | 121.7 | 10.0 | 0.29 | 2.23 |
| 4 | 1727.5 | 1609.3 | 118.2 | 130.9 | 121.4 | 9.5 | 0.30 | 2.05 |
| 5 | 1730.0 | 1610.8 | 119.2 | 130.8 | 121.5 | 9.3 | 0.30 | 2.13 |
| 6 | 1600.5 | 1468.5 | 132.0 | 121.1 | 110.9 | 10.2 | 0.31 | 2.29 |
| 7 | 1610.3 | 1480.1 | 130.2 | 121.6 | 111.8 | 9.8 | 0.30 | 2.14 |
| 8 | 1611.1 | 1482.5 | 128.6 | 121.7 | 112.1 | 9.6 | 0.29 | 2.20 |
| 9 | 1609.3 | 1484.1 | 125.2 | 121.4 | 112.0 | 9.4 | 0.30 | 2.10 |
| 10 | 1610.8 | 1487.5 | 123.3 | 121.5 | 112.2 | 9.3 | 0.27 | 2.24 |
| 11 | 1468.5 | 1345.6 | 122.9 | 110.9 | 101.8 | 9.1 | 0.30 | 2.09 |
| 12 | 1480.1 | 1353.1 | 127.0 | 111.8 | 102.2 | 9.6 | 0.27 | 2.13 |
| 13 | 1482.5 | 1363.0 | 119.5 | 112.1 | 102.8 | 9.3 | 0.28 | 2.01 |
| 14 | 1484.1 | 1361.8 | 122.3 | 112.0 | 102.8 | 9.2 | 0.29 | 1.98 |
| 15 | 1487.5 | 1367.6 | 119.9 | 112.2 | 103.1 | 9.1 | 0.28 | 1.93 |
| 16 | 1345.6 | 1225.0 | 120.6 | 101.8 | 92.5 | 9.3 | 0.27 | 2.04 |
| 17 | 1353.1 | 1237.5 | 115.6 | 102.2 | 93.4 | 8.8 | 0.29 | 1.86 |
| 18 | 1363.0 | 1246.0 | 117.0 | 102.8 | 94.1 | 8.7 | 0.27 | 1.94 |
| 19 | 1361.8 | 1250.1 | 111.7 | 102.8 | 94.2 | 8.6 | 0.30 | 2.10 |
| 20 | 1367.6 | 1253.5 | 114.1 | 103.1 | 94.6 | 8.5 | 0.27 | 2.05 |
| | Standard deviation | | 6.7 | Standard deviation | | 0.5 | | |
| | Total depth of material removal | | 2467.3 | Total weight loss | | 188.1 | | |

REFERENCE EXAMPLE

The lapping machine used was a 4-way double-sided lapping machine, Model 6B by Fujikoshi Machinery Corp. The surface of the upper and lower lapping plates was processed by the following method and under the following conditions, using dressing rings or abrasive members.

Plate:
- Material: spheroidal-graphite cast iron
- Size: 6B

Figure 10:
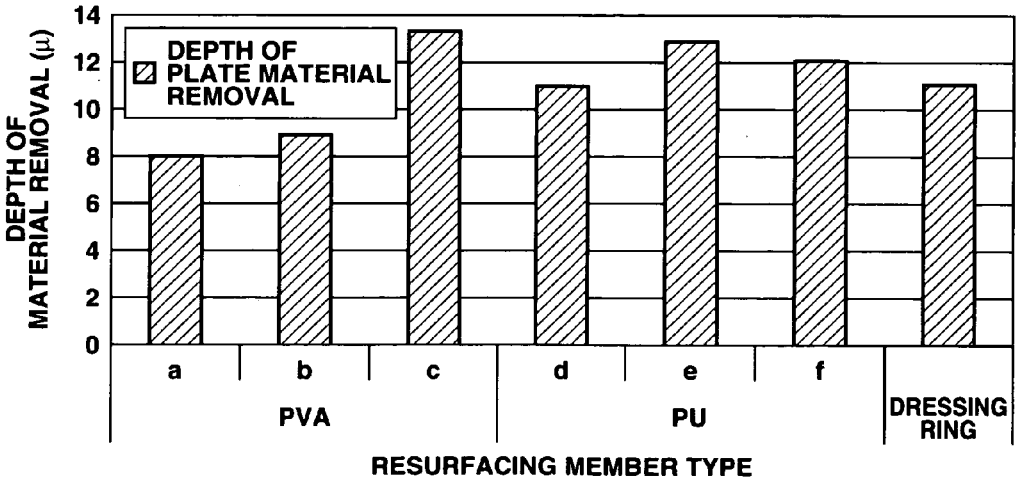
FIG. 10 is a graph showing depth of material removal when plates are lapped using different abrasive members in Reference Example.
Figure 11:
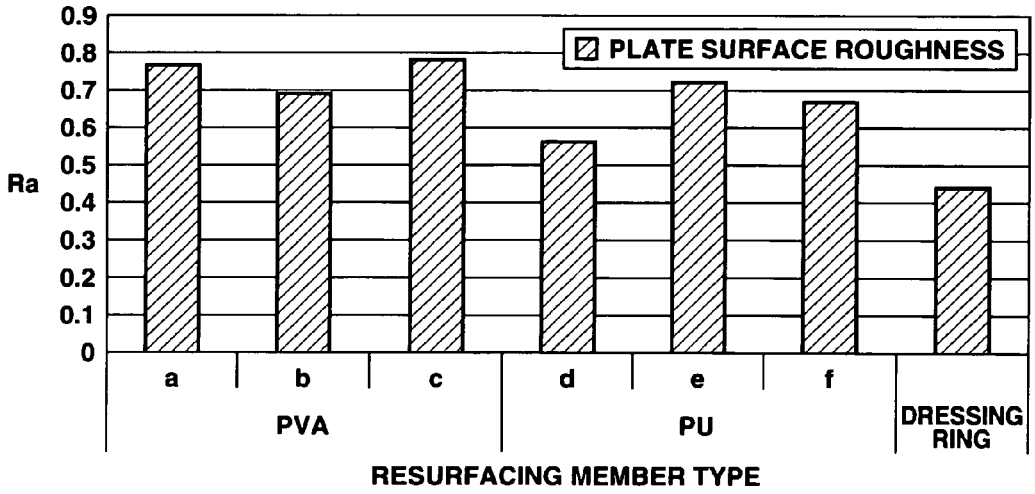
FIG. 11 is a graph showing surface roughness in the same test as in FIG. 10.

Dressing ring:
- Material: same as the plates
- Number: 4
- Size: 150 mm diameter Abrasive member PVA:

(a) polyvinyl acetal/melamine resin abrasive member with abrasive grains GC having 8 μm diameter
- Shape and size: 120 mm diameter
- Number: 4
- Cells: 30 μm diameter
- Rockwell hardness: −70
- Bulk density: 0.60 g/cm$^3$ (b) polyvinyl acetal/melamine resin abrasive member with abrasive grains GC having 14 μm diameter
- Shape and size: 120 mm diameter
- Number: 4
- Cells: 60 μm diameter
- Rockwell hardness: −60
- Bulk density: 0.65 g/cm$^3$ (c) polyvinyl acetal/melamine resin abrasive member with abrasive grains GC having 25 μm diameter
- Shape and size: 120 mm diameter
- Number: 4
- Cells: 40 μm diameter
- Rockwell hardness: −50
- Bulk density: 0.70 g/cm$^3$ Abrasive member PU:

(d) polyurethane abrasive member with abrasive grains C having 8 μm diameter
- Shape and size: 120 mm diameter
- Number: 4
- Cells: 100 μm diameter
- Rockwell hardness: −80
- Bulk density: 0.50 g/cm$^3$ (e) polyurethane abrasive member with abrasive grains C having 8 μm diameter
- Shape and size: 120 mm diameter
- Number: 4
- Cells: 100 μm diameter
- Rockwell hardness: −90
- Bulk density: 0.45 g/cm$^3$ (f) polyurethane abrasive member with abrasive grains C having 6.5 μm diameter
- Shape and size: 120 mm diameter
- Number: 4
- Cells: 80 μm diameter
- Rockwell hardness: −80
- Bulk density: 0.50 g/cm$^3$ Processing method and conditions:
- Lapping load: 100 g/cm$^2$
- Lower plate rotation: 60 rpm
- Upper plate rotation: 20 rpm
- Abrasive grains: GC #1500
- Abrasive slurry: 25% dispersion
- Abrasive slurry feed rate: 500 cc/min
- Lapping time: 30 min The plates thus processed were measured for depth of material removal and surface roughness, with the results shown in Table 8 and FIGS. 10 and 11.

TABLE 8

| Abrasive member type | Plate, depth of removal (μm) | Abrasive member, wear (μm) | Plate surface roughness Ra | Plate surface roughness Rz |
|---|---|---|---|---|
| PVA-a | 7.9 | 3667.5 | 0.77 | 3.84 |
| PVA-b | 8.9 | 4735 | 0.69 | 3.36 |
| PVA-c | 13.3 | 2512.5 | 0.78 | 4.35 |
| PU-d | 10.9 | 5382.5 | 0.56 | 3.84 |
| PU-e | 12.9 | 6480 | 0.72 | 5.49 |
| PU-f | 12.1 | 6565 | 0.67 | 3.76 |
| Dressing ring | 11.1 | | 0.44 | 3.82 |

Japanese Patent Application No. 2005-260526 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for resurfacing a lapping plate, comprising the steps of:

placing a resurfacing carrier with a holding hole on the lapping plate;

holding within the holding hole a porous synthetic resin-based elastic member having a Rockwell hardness (HRS) in the range of −30 to −100;

rotating the plate and the carrier individually;

feeding loose abrasive grains onto the plate to provide said loose abrasive grains between said elastic member and said plate; and creating pressure between said elastic member and said plate while said loose abrasive grains are between said elastic member and said plate and while said plate and carrier are rotating so that the surface of the plate is roughened with the elastic member in accordance with the coarseness of the abrasive grains, wherein said elastic member adjusts to said plate surface elastically.

2. The plate resurfacing method of claim 1, wherein the abrasive grains are the same as loose abrasive grains to be fed onto the plate when a workpiece is lapped.

3. The plate resurfacing method of claim 1, wherein the elastic member is a polyurethane or polyvinyl acetal-based abrasive member having a plurality of microscopic cells.

4. The plate resurfacing method of claim 1, wherein the elastic member has a bulk density of 0.4 to 0.9 g/cm$^3$.

5. The plate resurfacing method of claim 1, wherein the elastic member has abrasive grains dispersed and bound therein which are the same as loose abrasive grains to be fed onto the plate when a workpiece is lapped.

6. The plate resurfacing method of claim 5, wherein the workpiece is a silicon wafer, synthetic quartz glass, rock crystal, liquid crystal glass, or ceramics.

7. The plate resurfacing method of claim 1, wherein the lapping plate is made of spheroidal-graphite cast iron.

8. The plate resurfacing method of claim 1, wherein prior to the steps recited therein, a silicon wafer, a workpiece being a synthetic quartz glass, a rock crystal, a liquid crystal glass or a ceramic has been lapped with the lapping plate.

9. A lapping plate resurfacing apparatus comprising:

an elastic member comprising a porous synthetic resin-based elastic substance having a Rockwell hardness (HRS) in the range of −30 to −100; and an elastic member carrier with a hole disposed on the lapping plate to fit and carry the elastic member, said resurfacing apparatus being disposed to contact the elastic member to a surface of the lapping plate and to cause the lapping plate and the carrier to individually rotate so as to roughen the surface of the lapping plate when loose abrasive grains are present between said elastic member and said lapping plate when said lapping plate and said carrier are rotated, wherein said elastic member adjusts to said plate surface elastically.

10. The apparatus of claim 9, wherein the elastic member is a polyurethane or polyvinyl acetal-based abrasive member having a plurality of microscopic cells.

11. The apparatus of claim 9, wherein the elastic member has a bulk density of 0.4 to 0.9 g/cm$^3$.

12. The apparatus of claim 9, wherein the member contains abrasive grains dispersed and bound therein which are the same as the loose abrasive grains fed onto the plate when a workpiece is lapped.

13. The apparatus of claim 9, wherein the lapping plate is made of spheroidal-graphite cast iron.

14. A method for resurfacing a lapping plate, comprising the steps of:

lapping a workpiece, which is disposed in a holding hole of a carrier, with a lapping plate, the workpiece being a silicon wafer, a synthetic quartz glass, a rock crystal, a liquid crystal glass, or a ceramic, and thereafter, replacing the workpiece with a synthetic resin-based elastic member having a Rockwell hardness (HRS) in the range of −30 to −100;

holding within the holding hole the porous synthetic resin-based elastic member;

rotating the plate and the carrier individually while the synthetic resin-based elastic member is contacted to a surface of the plate, wherein said elastic member adjusts to said plate surface elastically; and feeding loose abrasive grains onto the plate, so that the surface of the plate is roughened with the porous elastic member in accordance with the coarseness of the abrasive grains.

* * * * *